United States Patent [19]

Edwards

[11] 4,144,004

[45] Mar. 13, 1979

[54] INTERMESHING GEAR ROTARY ENGINE WITH VALVED INLET

[76] Inventor: Ray B. Edwards, 1121 E. Tonto St., Phoenix, Ariz. 85034

[21] Appl. No.: 837,712

[22] Filed: Sep. 29, 1977

[51] Int. Cl.[2] ..... F01C 1/20; F01C 21/12

[52] U.S. Cl. ..... 418/185; 418/196

[58] Field of Search ..... 418/183, 185, 188, 191, 418/196

[56] References Cited

U.S. PATENT DOCUMENTS

| | | | |
|---|---|---|---|
| 12,874 | 11/1908 | Bleecker | 418/188 |
| 496,856 | 5/1893 | Case | 418/196 |
| 1,001,676 | 8/1911 | Ostergren | 418/196 |
| 2,724,340 | 11/1955 | Tryhorn | 418/196 |

FOREIGN PATENT DOCUMENTS

| | | | |
|---|---|---|---|
| 28652 | 11/1932 | Netherlands | 418/183 |

*Primary Examiner*—John J. Vrablik

*Attorney, Agent, or Firm*—Warren F. B. Lindsley

[57] ABSTRACT

A positive displacement engine utilizing interlocking vaned rotors and providing for the virtually complete exclusion of spent vapors following the expansion cycle.

5 Claims, 7 Drawing Figures

INTERMESHING GEAR ROTARY ENGINE WITH VALVED INLET

BACKGROUND OF THE INVENTION

With the growing realization that the world supply of fossil fuels is gradually being diminished, increased attention is being given to the utilization of renewable sources of energy. The search is now underway for new and better ways to harness the winds, the tides and the radiation from the sun.

In the growing utilization of these and other long-neglected energy sources, new and different energy-conversion means will become practical or more nearly optimum. Thus, for example, while large steam turbines have performed admirably in the conversion of energy from coal or gas, the relatively lower temperatures realized in solar collectors seriously limit the efficiency of this conversion means in a solar energy system.

Other factors which argue against the use of steam turbines in solar systems are the typically smaller scale and the variability in the power levels at which they are ordinarily operated. Vapor turbines tend toward low efficiencies in the smaller sizes due in the main to extremely small inlet volume of the fluid and the narrow speed band over which their efficiencies peak.

Another class of converters, the positive displacement or quasi-positive displacement expanders, might prove better suited to such applications. This class includes the conventional steam engine and various types of lobed or vaned rotary expanders. Most expanders, however, are beset with the problem of irreversible heat transfer which significantly reduces the available energy. In addition, they are limited by the relatively low volume expansion ratios achievable in a practical engine design.

Means have been found for the relief of some of these deficiencies. Superheating the working fluid increases the ratio of specific heats so that for a fixed volume expansion the temperature drop is maximized. In addition, the irreversibilities associated with moisture in the vapor are largely eliminated thereby.

The most efficient types of steam engines in the condensing regime are called uni-flow engines. In these types of engines the hot steam is caused to flow over hot surfaces and the cold wet steam is "blown down" over relatively cool surfaces. This technique minimizes the availability loss otherwise caused by mixing together elements of different temperatures. However, one remaining weakness is that during the recompression of the residual exhaust steam left in the cylinder, heat is irreversibly transferred as the entrained drops are re-evaporated.

Additional improvements in operating efficiencies are essential to the practical application of these engines in the new environment of an energy-conscious society. A promising approach for achieving such an improvement comprises a means for totally expelling the residual exhaust products at the completion of the "blow-down" phase.

SUMMARY OF THE INVENTION

In accordance with the invention claimed, an improved positive displacement expander is provided in the form of a rotary mechanically-lobed device in which blowdown is followed by the nearly total expulsion of the exhaust products.

It is, therefore, one object of this invention to provide a positive displacement engine or expander which exhibits improved operating efficiency over existing types.

Another object of this invention is to provide such an expander in a form which achieves improved efficiency by effecting a virtually total expulsion of the exhaust products at the completion of each cycle.

A further object of this invention is to provide such an engine in a form which utilizes a minimum number of moving parts.

A still further object of this invention is to provide such an engine in a form which is economical and efficient in relatively low power ratings and at relatively low vapor temperatures.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
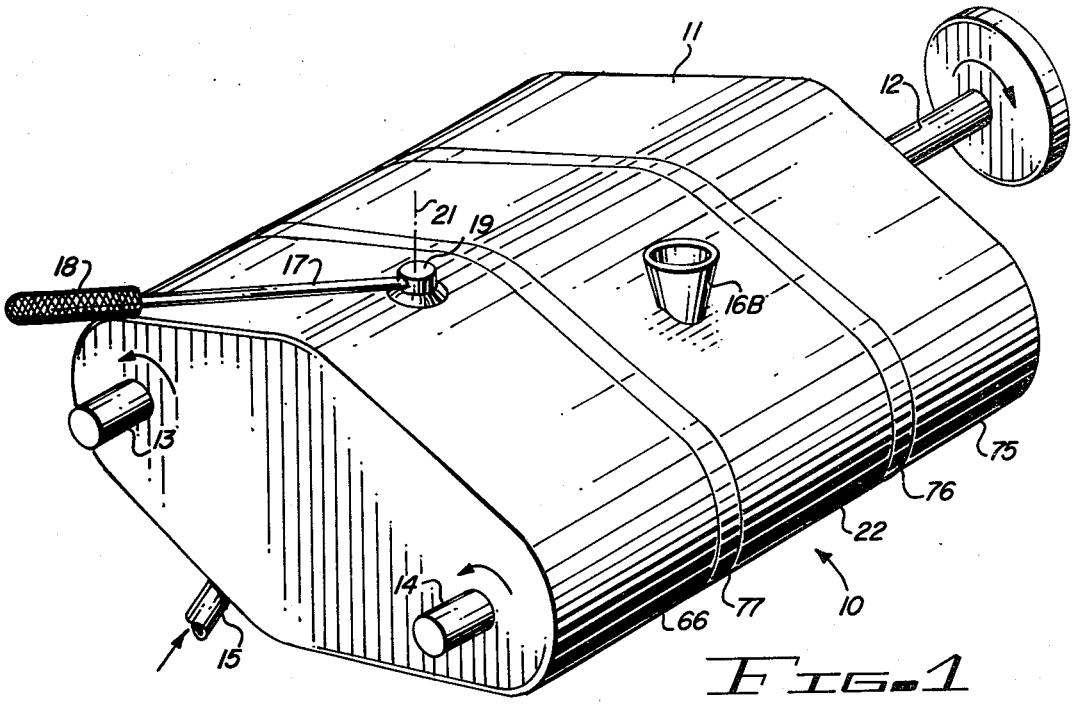
FIG. 1 is a perspective view of the positive displacement vapor engine of the invention showing its exterior features.
Figure 2:
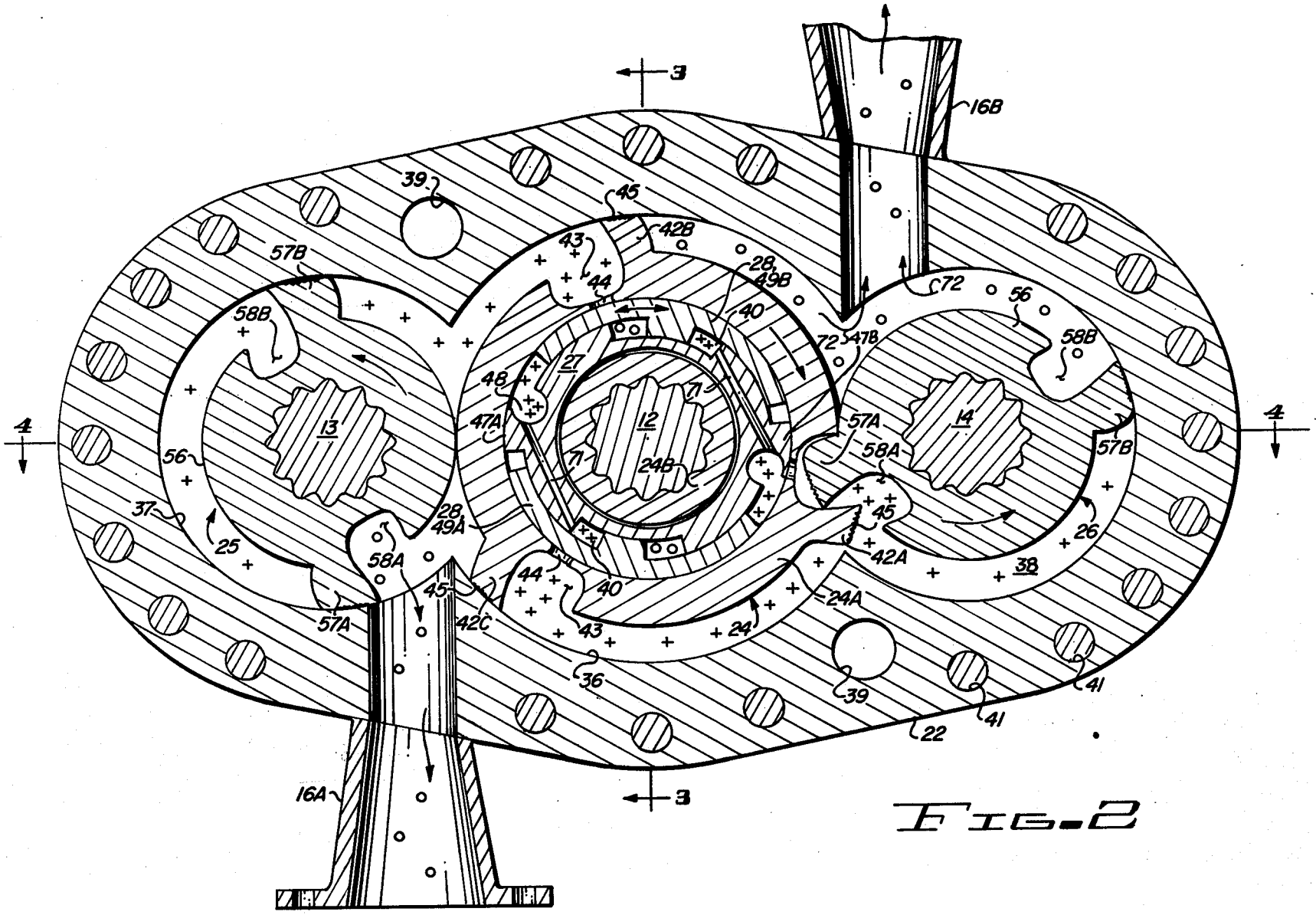
FIG. 2 is a cross-sectional view of the engine of FIG. 1 taken along line 2—2 of FIG. 3.

Referring more particularly to the drawing by characters of reference, FIGS. 1-7 disclose a positive displacement vapor expander or engine 10, its external features as shown in FIG. 1 comprising a housing 11 formed by segments 75, 76, 22, 77 and 66, main drive shaft 12 extending out of one end of housing 11, two auxiliary drive shafts 13 and 14 coplanarly aligned with shaft 12 one on each side thereof, a vapor intake port 15, two exhaust ports 16A and 16B, the first being hidden from view in FIG. 1 and shown in FIG. 2, and a cut-off control lever 17.

The housing 11 has a uniform cross-sectional outline as viewed in the direction of its longitudinal axis, the outline taking the general form of a flattened circle or oval. The forward and rear ends of housing 11 may be cut off squarely or tapered as so desired.

The vapor intake port 15 is most conveniently located at the rear center of the underside of housing 11. Exhaust port 16A, shown in FIG. 2 is located near the center left underside of housing 11 and second exhaust port 16B is located on the top surface of housing 11 near the center right hand side of housing 11.

The cut-off control lever 17 has a grip 18 at its free end and is attached at its other end to the side of a vertical shaft 19 which is rotatable about its vertical axis 21. Shaft 19 emerges from the top rear center surface of housing 11 and lever 17 is rotated in a horizontal arc about axis 21 to rotate shaft 19. As shaft 19 is rotated the flow of vapor through engine 10 is caused to increase or decrease.

FIG. 2 illustrates a housing 22 defining expansion chambers to be later defined, and further comprising a main rotor 24, secondary rotors 25 and 26, inner cut-off control collar or section 27, outer cut-off control collar or section 28, shafts 12, 13 and 14 and exhaust ports 16A and 16B.

Housing 22 defines an opening formed in the shape of three intersecting cylindrical bores parallelly arranged in side-by-side configuration with their axes co-planar. The center cylindrical bore 36 is larger than the other two and houses main rotor 24. The two smaller cylindrical bores 37 and 38 positioned to the left and right of bore 36, as shown in FIG. 2, house the secondary rotors 25 and 26, respectively. Exhaust port 16A opens into the lower wall of bore 37 immediately to the left of the intersection of bore 37 with bore 36, and exhaust port 16B opens into the upper wall of bore 38 just to the right of the intersection of bore 38 with bore 36. Two large holes 39 and a number of smaller holes 41 surrounding the bores 36, 37 and 38 are provided to receive bolts which secure the components of engine 10 together as a unit.

Rotor 24, as shown in FIGS. 2, 3, 4 and 5, has an outer cylindrical shell 24A and an inner cylindrical shell 24B, the inner and outer shells being joined at the forward end by a disc-shaped web 24C.

Outer shell 24A has a wall thickness which is about one-fourth the radius of the outer surface of shell 24A. Three longitudinal vanes 42A, 42B and 42C symmetrically positioned 120 degrees apart about the periphery of shell 24A extend outwardly from the outer surface of shell 24A a distance equal approximately to the thickness of shell 24A. Adjacent to each of the vanes 42A–42C and positioned counter-clockwise therefrom is a longitudinal depression 43 extending almost completely to the inner surface of outer shell 24A, its radial width being somewhat greater than the width of one of the vanes 42A–42C and its surfaces arcuately shaped to form a U-shaped channel, the base of which opens through a centered longitudinal slot 44 to the inner surface of shell 24A.

Inner shell 24B may, for example, have an outer diameter equal, approximately, to one-half the outer diameter of shell 24A so that the distance between the outer cylindrical surface of shell 24B and the inner cylindrical surface of shell 24A is approximately equal to one-fourth the radius of the outside surface of shell 24A. Other diameter ratios are possible and fall within the scope of this invention. The inner cylindrical surface of shell 24B is fluted to mate with the fluted outer surface of shaft 12 to which rotor 24 is mounted, the mating fluted surfaces assuring the fixed relationship between rotor 24 and shaft 12 but permitting a number of discrete angular positions for rotor 24 on shaft 12 in assembly.

The vanes 42A–42C extend to the walls of bore 36 leaving only sufficient clearance to permit the free rotation of rotor 24 within bore 36. A labyrinth seal 45 or other seal configuration is provided along the length of the outer surface of each of the vanes to impede or stop the flow of vapor between the surface of the vane and the walls of bore 36.

Positioned co-axially between the outer and inner shells 24A and 24B are the inner and outer cut-off control sections 27 and 28.

Inner cut-off control section 27 has the general form of a cylindrical shell, its inner diameter being just sufficiently greater than the outer diameter of the inner shell 24B to permit its free rotation thereon. The outer diameter of section 27 over most of its surface is such that the thickness of the shell of section 27 extends roughly two-thirds the radial distance from the outer surface of shell 24B to the inner surface of shell 24A. Two wide grooves 46A and 46B extend longitudinally along the outer surface of section 27, groove 46A being 180 degrees displaced from groove 46B. The depth of each of the grooves is approximately equal to half the thickness of shell 27 and the width covers an arc of approximately 50 degrees. Positioned midway between the grooves 46A and 46B at opposite ends of a diameter 180 degrees displaced from the centers of the grooves are two projections 47A and 47B, the overall angular width of each covering approximately 20 degrees. The clockwise edge of each projection 47A and 47B is undercut by a cylindrical bore 48 which extends into the shell of section 27 to a depth corresponding roughly to the depth of the grooves 46A and 46B.

Outer cut-off control section 28 has a partial cylindrical shell with two longitudinal openings, each covering approximately 50 degrees, located diametrically opposite each other. As shown most clearly in FIG. 5, the two sides 49A and 49B of the shell are held together by a flat ring 51 located at one end. At the opposite end of side 49B, a heavy radially extending collar 52 has its tapered outer surface 53 machined to form a section of a bevel gear for engagement with another bevel gear 54 attached to the lower end of shaft 19. A similar collar 55 is provided at the free end of said 49A, but collar 55 has no bevel gear section. The inner surfaces of the sides 49A and 49B are generally cylindrical, but have at their centers longitudinal ridges 50A and 50B, respectively, the ridges being equal in width to about one-half the width of the grooves 46A and 46B of control section 27.

As illustrated by FIGS. 2, 3, 4 and 5, outer section 28 fits snugly over the outer cylindrical surface of inner section 27 with projections 47A and 47B extending through the openings between sides 49A and 49B and with ridges 50A and 50B of section 28 extending, respectively, into the grooves 46B and 46A of section 27. The assembled inner and outer control sections 27 and 28 fit snugly between the outer and inner shells 24A and 24B of rotor 24, all clearances between parts 24, 27 and 28 being just sufficient to permit the free rotation of any one part relative to the other two. The entire assembly of parts 24, 27 and 28 with rotor 24 mounted to shaft 12 is centered in bore 36 of housing 22.

Figure 6:
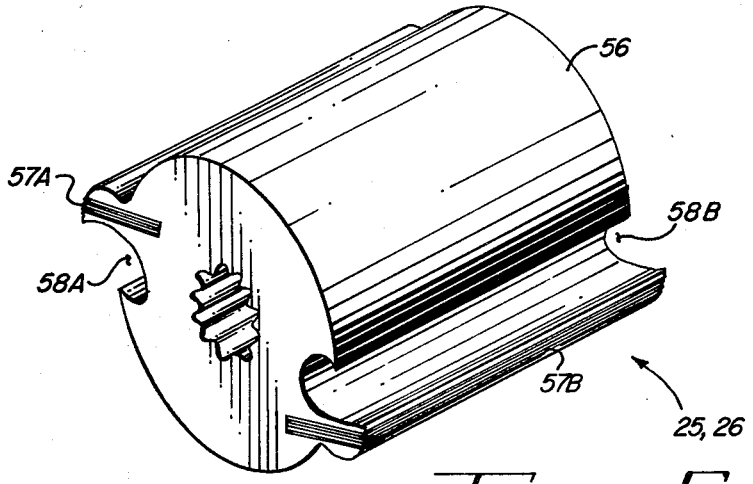
FIG. 6 is a perspective view of the rotor employed in each of the two auxiliary or side chambers of the engine of FIGS. 1-4.

Each of the secondary rotors 25 and 26, as shown most clearly in FIGS. 2 and 6, has a cylindrical body 56 with two longitudinal vanes 57A and 57B and two longitudinal depressions 58A and 58B. The vanes 57A and 57B are similar to the vanes 42A–42C of rotor 24 and the depressions 58A and 58B are approximately equivalent to the depressions 43 of rotor 24. Vane 57A is positioned diametrically opposite vane 57B and the depressions 58A and 58B are positioned adjacent vanes 57A and 57B, respectively, on the counter-clockwise sides thereof as viewed in FIG. 2. Rotor 25 is mounted to shaft 13 by means of a fluted inner bore and rotor 26 is mounted in the same manner to shaft 14.

As shown in FIG. 2, the rotors 24, 25 and 26 work rotationally within the bores 36, 37 and 38, respectively, of housing 22. The outer cylindrical surface of rotor 24 is in virtual physical contact with the outer cylindrical surface of rotor 25 on its left side and with the outer cylindrical surface of rotor 26 on its right side. The diameter of the outer cylindrical surface of rotor 24 is one and one-half times as large as the diameter of the outer cylindrical surface of rotor 25 and 26 so that if rotor 24 is rotated one turn while maintaining surface contact with rotor 25 or 26 and not permitting slippage between contacting surfaces, rotor 25 or 26 must rotate one and one-half turns each. For the arrangement shown in FIG. 2, if rotor 24 is rotated in a clockwise direction, the resulting rotation of rotors 25 and 26 would be counter-clockwise.

To permit the rotation of rotors 24, 25 and 26 in the above described manner, the relative angular positions of the three rotors must be set to provide for the intermeshing of the vanes 42 of rotor 24 with the depressions 58 of rotors 25 and 26 and of the vanes 57 of rotors 25 and 26 with the depressions 43 of rotor 24. Thus, for example, as rotor 24 turns in a clockwise direction from the position shown in FIG. 2, vane 42A has just lifted from depression 58A of rotor 26, and vane 57A of rotor 26 is meshed with depression 43 of rotor 24. Following approximately thirty degrees additional rotation of rotor 24, vane 42C will mesh with depression 58A of rotor 25. Vane 42B of rotor 24 will next mesh with depression 58B of rotor 26, etc.

Figure 7:
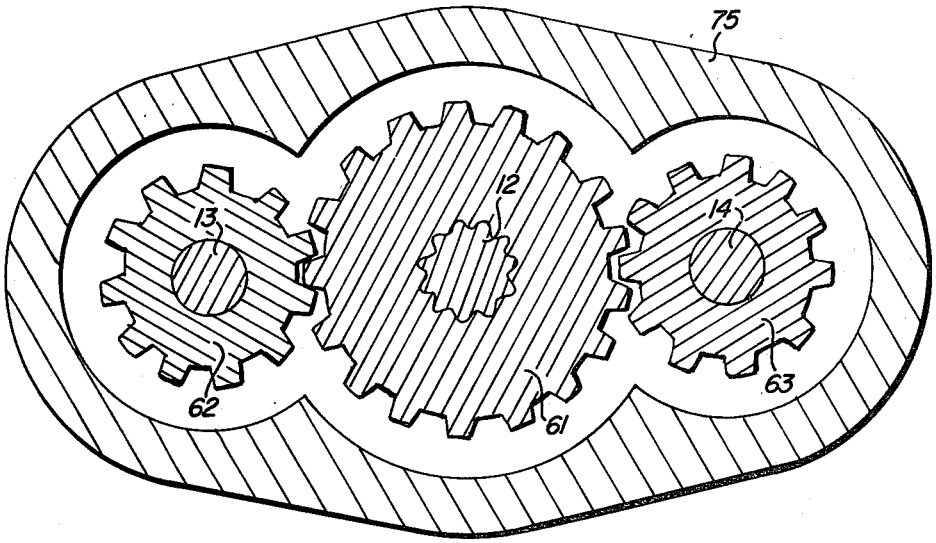
FIG. 7 is a cross-sectional view of the engine of FIGS. 1-4 as viewed along line 7—7 of FIG. 4.
Figure 3:
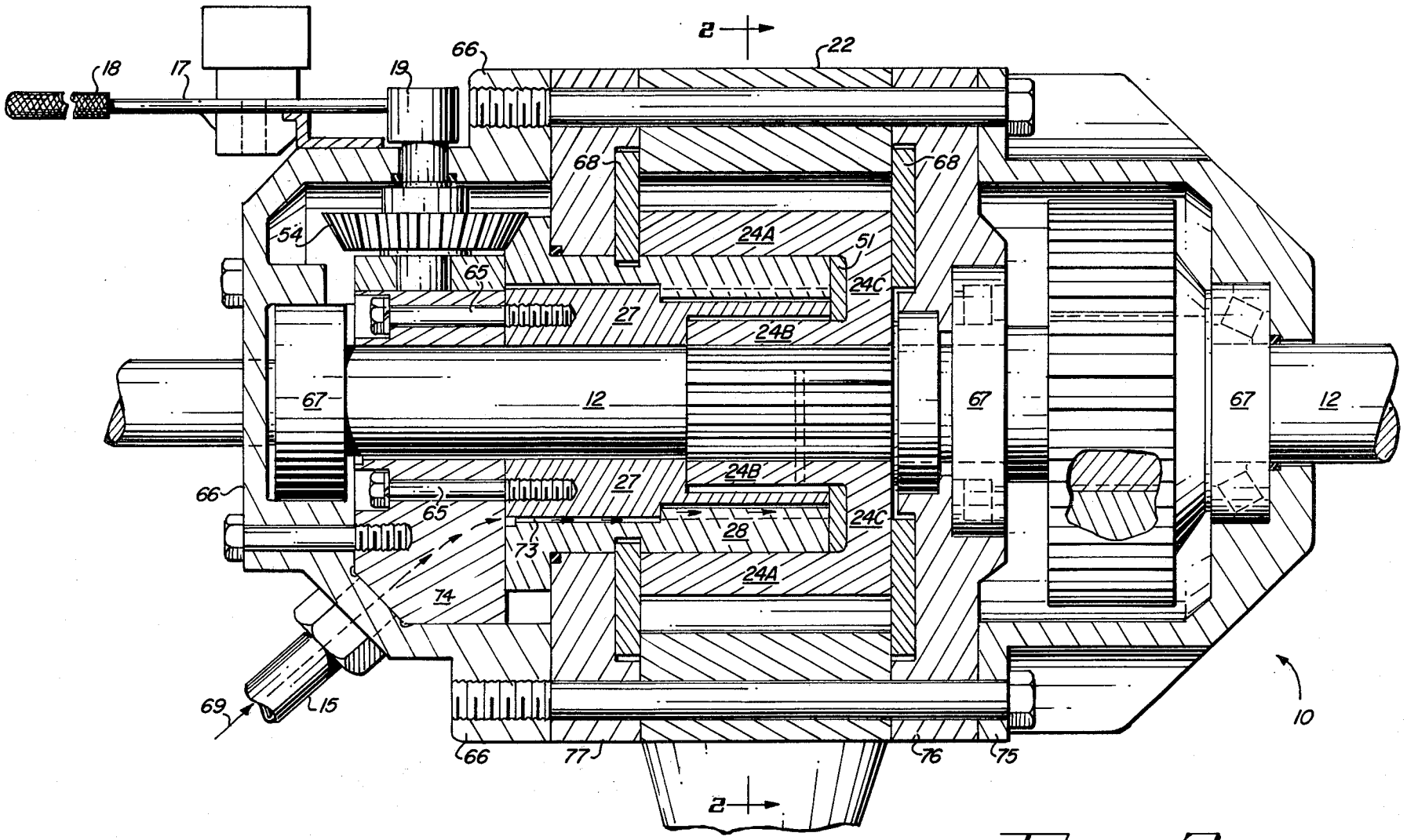
FIG. 3 is a cross-sectional view of the engine shown in FIGS. 1 and 2 as viewed along line 3—3 of FIG. 2.
Figure 4:
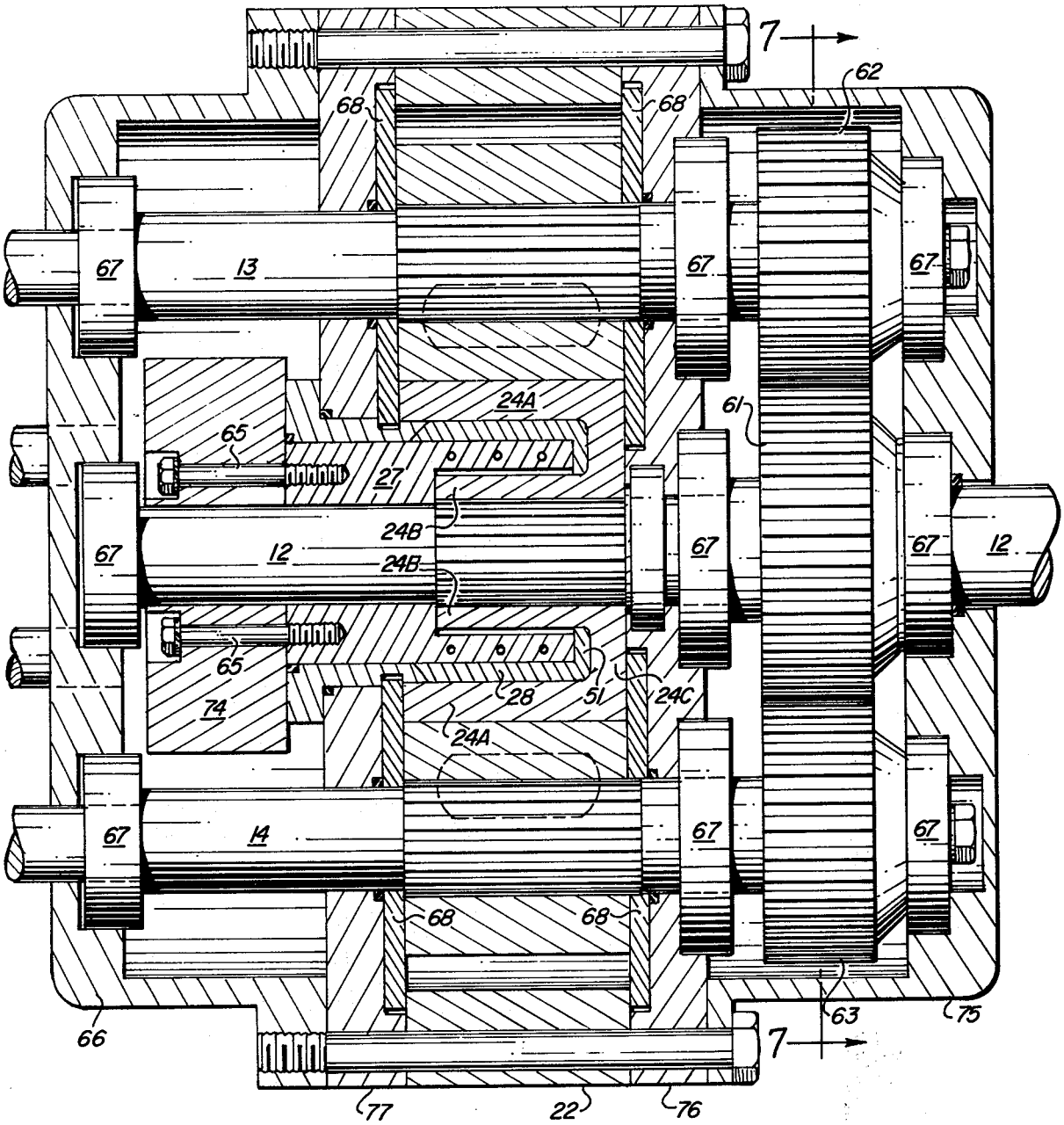
FIG. 4 is a cross-sectional view of the engine shown in FIGS. 1-3 taken along 4—4 of FIG. 2.
Figure 5:
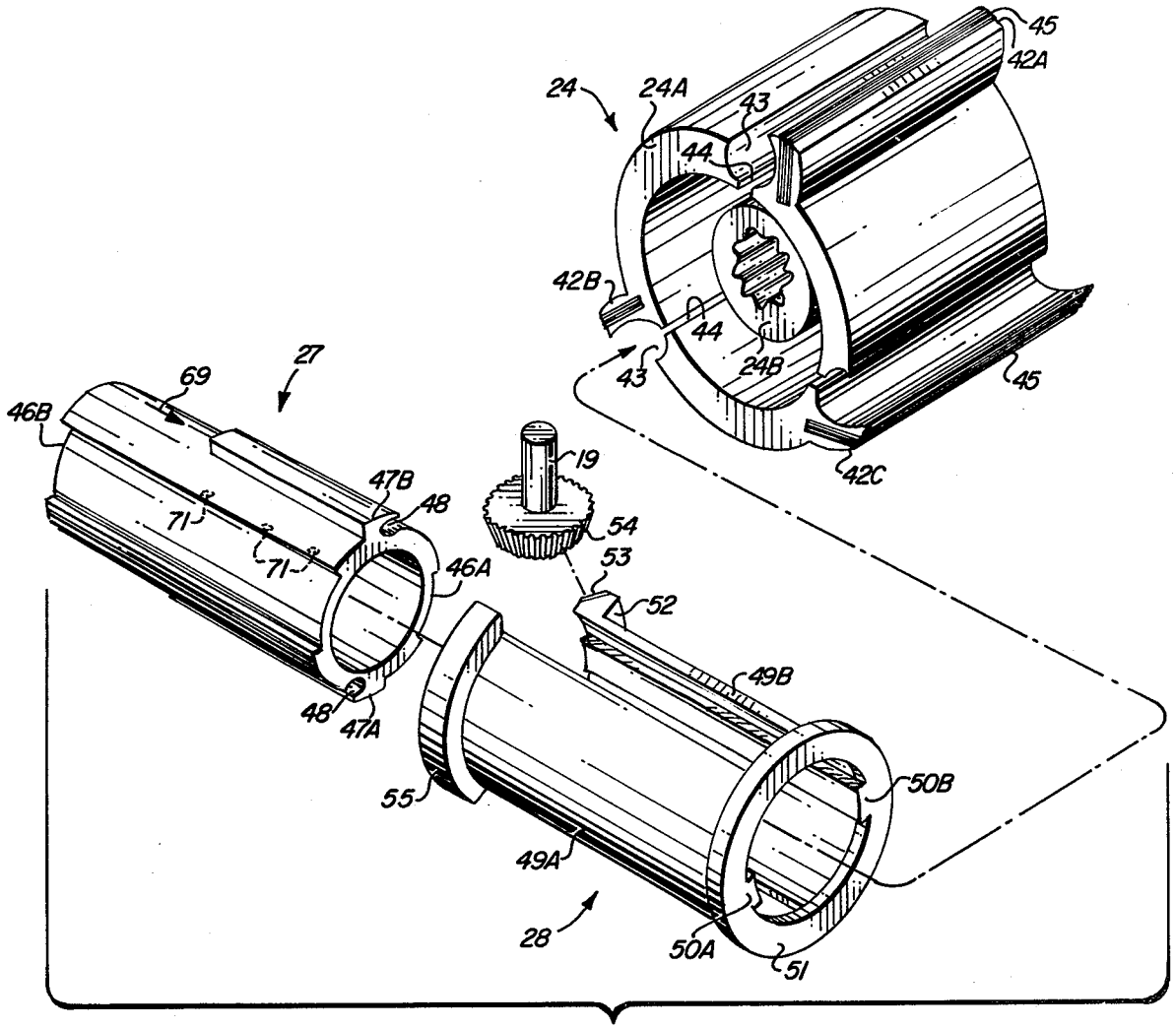
FIG. 5 is an exploded perspective view of the key elements operating within the main central chamber of the engine of FIGS. 1-4.

To guarantee the maintenance of the proper relative angular positions of the rotors 24, 25 and 26 so that such intermeshing will occur, the three shafts 12, 13 and 14 are coupled together by gears 61, 62 and 63, as shown most clearly in FIGS. 4 and 7. Gear 61 has one and one-half times as many teeth as gear 62 or 63 so that the angular velocity of gear 62 or 63 is one and one-half times that of gear 61. Further significant details of construction are shown in FIGS. 3 and 4.

As shown in FIG. 3, outer cut-off control section 28 is coupled directly to bevel gear 54 which in turn is mounted on shaft 19 for rotational control by cut-off control lever 17. Inner cut-off control section 27 is secured in a fixed position by bolts 65 to the inlet block 74 of engine 10. Shafts 12, 13 and 14 are mounted to frame 66 by means of bearings 67. End seal plates 68 with shaft seals close the ends of bores 36, 37 and 38.

In operation, the high pressure inlet vapor 69 enters through intake port 15 into chamber 73 within inlet block 74. From chamber 73 the vapor 69 passes over the outer surface of cut-off control section 27 entering the inlet ends of the bores 48 of control section 27 so that high pressure vapor is available at all times within bore 48. As rotor 24 moves just beyond its position shown in FIG. 2, groove 44 of rotor 24 clears the tip of projection 47B and vapor is admitted into depression 43 through slot 44 from bore 48. As rotation of rotors 24, 25 and 26 continues, additional quantities of high pressure vapor are admitted into depression 43 while vane 57A leaves depression 43 until slot 44 moves past the edge of side 49A of control section 28. By this time, a relatively large quantity of high pressure vapor has accumulated behind the trailing edges of vanes 42A and 57A of rotors 24 and 26, respectively, and the high pressure vapor thus confined urges the continued rotation of rotors 24, 25 and 26.

Pressure conditions in the vapor chambers of FIG. 2 are indicated by plus signs (+) and zeros (0). A high concentration of plus signs indicates high pressure. A lower concentration of plus signs indicates a relatively lower pressure and a distribution of zeros indicates low or atmosphereic pressure. Thus, in the bores 48, the high concentration of plus signs indicates vapor at its high inlet pressure. In the space within bores 36 and 38 just below rotors 24 and 26, high pressure vapor which had been introduced 120 degrees earlier relative to the rotation of rotor 24 has expanded as vanes 42C and 57B of rotors 24 and 26 were driven apart. With such expansion, the pressure of the vapor is accordingly reduced as indicated by the more sparsely distributed plus signs. A similar condition exists between vanes 42B and 57B of rotors 24 and 25 where vapor introduced sixty degrees earlier through the slot 44 adjacent vane 42B is expanding to drive vanes 42B and 57B apart.

In the space between vanes 42B and 57B of rotors 24 and 26, respectively, low pressure vapor 72 is being swept toward exhaust port 16B by the advancing vanes 42B and 57B. In the same fashion, vanes 42C and 57A of rotors 24 and 25 have nearly completed the explusion of exhaust products through port 16A.

In the design of the vanes 42 and 57 and the depressions 43 and 58 the contours of the vanes and depressions are carefully controlled so that for any angular position of the rotors 24, 25 and 26 an effective seal is maintained between the high pressure and low pressure chambers.

It will now be evident from an examination of FIGS. 2 and 3 that the power delivered by engine 10 may be adjusted by rotating the outer cut-off control section 28 through the use of control lever 17. As section 28 is rotated counter-clockwise in FIG. 2, the groove 44 remains cleared for a shorter period of time at a given angular velocity so that a reduced amount of high pressure vapor is admitted and a reduced level of power is developed. Clockwise rotation of section 28 produces the opposite effect. As control section 28 is rotated relative to control section 27, the voids 40 between the groove 46A or 46B of section 27 and the ridge 50B or 50A are enlarged or reduced. Confined vapor trapped in the voids 40 will resist such relative rotation. To prevent such confinement of vapor in voids 40 the small pressure-equalizing orifices 71 are provided between voids 40 and the bores 48. It will be apparent, of course, that automatic control of the position of control section 28 may be effected if desired to achieve constant speed under variable load or to provide other operating modes.

The engine as described incorporates only three moving assemblies comprising the shafts, gears and three rotors 24, 25 and 26, these parts moving in rotation only so that wear and mechanical energy losses are held to a minimum. The relatively simple mechanical construction also lends itself to the realization of a low manufacturing cost.

Although but a single embodiment of the invention has been illustrated and described, it will be apparent to those skilled in the art that various changes and modifications may be made therein without departing from the spirit of the invention or from the scope of the appended claims.

What is claimed is:

1. A rotary engine comprising:

a housing defining at least two intersecting coplanar arranged cylindrical bores, first and second rotor means journaled in said housing one in each of said bores, a pair of intermeshing gears one mounted on the end of each of said rotor means, said rotor means each being contoured to provide around its periphery at least a pair of spaced dual purpose vanes for interlocking with the other vanes of the other rotor means upon rotation of said first rotor means and to provide a first vapor chamber means between one vane of each rotor means and another vane of the other rotor means and the periphery of the bore within which the associated rotor means rotates, said first rotor means being slotted to receive within the slot a pair of coaxially arranged collars, one of said collars being fixedly attached to said housing and the other of said collars being adjustably movable relative to said first collar, said collars defining between them a second vapor chamber means, passage means selectively interconnecting said first chamber means with said second chamber means, means on said collars forming at least one void when said other collar is moved relative to said first collar, passage means through one of said collars for equalizing the pressure between said second vapor chamber means and any void existing between said collars, said rotor means meeting in rolling contact throughout the remainder of their periphery when the vanes are not interlocked, said rolling contact providing a fixed portion of said first and second chamber means, said second vapor chamber means being a non-expansion vapor storage chamber assuring a constant source of supply for said first vapor chamber means which is an expansion chamber, means connected to said other collar for selectively moving said other collar relative to said first collar for controlling vapor flow into said second chamber means, an inlet vapor port connected to said second vapor chamber means, and an outlet vapor port connected to said first vapor chamber means.

2. The rotary engine set forth in claim 1 in further combination with:

first and second drive shafts connected one to each of said rotor means.

3. The rotary engine set forth in claim 1 wherein:

said housing defines three or more intersecting coplanar-arranged cylindrical bores, first, second and third rotor means journaled in said housing one in each of said bores, and three or more intermeshing gears one mounted on the end of each of said rotor means.

4. The rotary engine set forth in claim 1 wherein:

each vane is provided with a juxtapositioned cavity into which an associated vane of one of the other rotor means enters upon rotation of said rotor means, and said passage means extends from said first chamber means into said cavity which forms a part of said second cavity means.

5. The rotary engine set forth in claim 1 wherein:

the selective movement of said other collar by said means controls the time said passage means is connected to said first chamber means.

* * * * *